US006558230B2

(12) United States Patent
Kondo et al.

(10) Patent No.: US 6,558,230 B2
(45) Date of Patent: May 6, 2003

(54) METHOD FOR POLISHING AND CHAMFERING RARE EARTH ALLOY, AND METHOD AND MACHINE FOR SORTING OUT BALL MEDIA

(75) Inventors: Sadahiko Kondo, Takarazuka (JP); Toshiaki Sasaki, Makati (PH); Toshifumi Hiyoke, Mukou (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/886,410

(22) Filed: Jun. 22, 2001

(65) Prior Publication Data

US 2002/0077032 A1 Jun. 20, 2002

(30) Foreign Application Priority Data

Jun. 23, 2000 (JP) ..... 2000-190184

(51) Int. Cl.[7] ..... B24B 1/00
(52) U.S. Cl. ..... 451/32; 451/35
(58) Field of Search ..... 451/32, 33, 34, 451/35, 36, 326, 327, 328, 329, 330

(56) References Cited

U.S. PATENT DOCUMENTS 4,770,723 A 9/1988 Sagawa et al.
4,792,368 A 12/1988 Sagawa et al.
6,095,901 A * 8/2000 Robinson et al. ..... 451/35

FOREIGN PATENT DOCUMENTS

| | | |
|---|---|---|
| JP | 54-27672 | 9/1979 |
| JP | 55-142250 | 10/1980 |
| JP | 62-32761 | 8/1987 |
| JP | 63-139658 | 6/1988 |
| JP | 05-208360 | 8/1993 |
| JP | 05-214495 | 8/1993 |

OTHER PUBLICATIONS

Notice from Japanese Patent Application No. 2001–181071 dated Aug. 28, 2002, English and Japanese.
"Handbook for ceramics machining", Published Nov. 30, 1987, partial translation of underlined portion on p. 315, pp. 309–319.

* cited by examiner

*Primary Examiner*—George Nguyen
*Assistant Examiner*—Dung Van Nguyen
(74) *Attorney, Agent, or Firm*—Nixon Peabody LLP; Jeffrey L. Costellia

(57) ABSTRACT

A method for polishing and chamfering a rare earth alloy including the steps of: preparing rare earth alloy work, feeding the rare earth alloy work, ball media, a liquid medium, and spacer particles (in an amount of 0.1% to 10% by volume of the liquid medium) into a container, and subjecting the rare earth work to polishing by vibrating the container.

9 Claims, 5 Drawing Sheets

METHOD FOR POLISHING AND CHAMFERING RARE EARTH ALLOY, AND METHOD AND MACHINE FOR SORTING OUT BALL MEDIA

BACKGROUND OF THE INVENTION

1. Field of the Invention

The present invention relates to a method for polishing and chamfering a rare earth alloy, and a method and machine for sorting out polishing media. More particularly, the present invention relates to a polishing and chamfering method using polishing media, like a barrel polishing method, a method for sorting out polishing media used for polishing from objects to be polished, and a machine used for the sorting of the polishing media.

2. Description of Related Art

Rare earth alloys have been used as materials for strong magnets. Rare earth magnets produced by magnetizing rare earth alloys have been suitably used as a material for a voice coil motor (VCM) for positioning a magnetic head of a magnetic recording apparatus, for example.

Barrel polishing has been conventionally employed due to its superiority in mass-productivity for polishing and chamfering work pieces of a rare earth alloy. As used herein, chamfering refers to polishing a work piece to round the edges of the work piece. Two types of barrel polishing, rotary barrel polishing and vibration barrel polishing, are available. Rotary barrel polishing is widely used because a machine for this polishing is inexpensively available.

Rare earth alloys are brittle materials and are therefore easily chipped. To avoid chipping, it is generally suitable to adopt vibration barrel polishing rather than rotary barrel polishing. The reason is presumed to be that in vibration barrel polishing, a spiral flowing state is established, and this reduces collision between polishing media (hereinafter referred to as "media") and objects to be polished and also between objects to be polished. Media and objects to be polished are rubbed against each other while flowing spirally in the same direction. In this way, polishing proceeds moderately.

Japanese Laid-Open Patent Publication No. 5-208360 discloses a vibration barrel polishing method in which a spiral flow is generated in a liquid in which all of the media and objects to be polished are immersed when a barrel bath is in the horizontal position, and describes that chipping can be further suppressed by this method.

The present inventors examined in various ways the methods for chamfering a rare earth alloy and found that, although the above conventional vibration barrel polishing method can suppress chipping to some extent, it may fail to provide uniform chamfering. In particular, this failure in uniform chamfering occurs when a plurality of flat work pieces are to be polished at one time, for example. In such a case, the work pieces firmly adhere to each other in the barrel bath, and thus part of edges of the work pieces are kept away from contact with the media.

In addition, chipping may occur even using the vibration barrel polishing method when the object to be polished is a work piece of a rare earth alloy including a rigid major phase mainly causing a brittle fracture and a grain boundary phase causing a ductile fracture, such as a rare earth alloy produced by sintering (hereinafter, referred to as a "rare earth sintered alloy").

Chipping may also occur in a process of sorting out the media from the work pieces (objects to be polished) after the barrel polishing process, in which work pieces tend to collide against each other. As the sorting method, generally used is a method (called a "sifting method") in which a mixture of media and work pieces is put in a sieve and the media are selectively dropped through the sieve under vibration. In this sifting method, the work pieces left on the sieve inevitably collide against each other, and thus chipping occurs.

In addition, the work pieces made to firmly adhere to each other in the barrel polishing process as described above are kept in the adhesion state in the sorting process. This means that a liquid medium (typically, water) with which the work pieces firmly adhere to each other is kept in touch with the work pieces for a comparatively long time. The rare earth alloy described above, which is highly susceptible to corrosion (easily rusts), should preferably be swiftly cleaned and surface-treated after chamfering. However, swift execution of these processes is difficult for such work pieces that firmly adhere to each other, and thus corrosion tends to occur.

SUMMARY OF THE INVENTION

An object of the present invention is to provide a method, in which polishing media is used to polish work pieces like a barrel polishing method, for chamfering a rare earth alloy that can suppress chipping of work pieces and also suppress adhesion of work pieces to each other during polishing to enable uniform chamfering.

Another object of the present invention is to provide a method for sorting out ball media while suppressing collisions between objects to be polished, and a machine for sorting out ball media permitting such sorting.

The method for chamfering a rare earth alloy of the present invention includes the following steps: preparing rare earth alloy work pieces, feeding the rare earth alloy work pieces, media, a liquid medium, and spacer particles (0.1% to 10% by volume of the liquid medium) into a container, and subjecting the rare earth work to polishing by vibrating the container.

The liquid medium is preferably fed into the container so that at least three-fourths of the bulk volume of the rare earth alloy work and the media are immersed in the liquid medium.

The average particle size of the spacer particles is preferably in a range of 0.05 mm to 1 mm, more preferably in a range of 0.1 mm to 0.5 mm.

The specific gravity of the media and the specific gravity of the spacer particles are preferably 4 or less.

The media preferably include alumina grains and a binder, and the weight percentage of the alumina grains is in a range of 45% to 48%. The porosity of the media is preferably 3% or less.

In the step of subjecting the rare earth work pieces to polishing, the container is preferably vibrated so that the amplitude in the horizontal direction is 0.4 mm or more and the amplitude in the vertical direction is 0.15 mm or more. Also, the container is preferably vibrated at an acceleration of 800 mm/sec$^2$ or more in the horizontal direction.

Ball media is preferably used as the media.

The method for sorting out ball media of the present invention includes supplying a mixture including ball media and an object to be polished to a slope, and allowing the ball media to roll along the slope to be removed from the slope, and the object to be polished to stay on the slope.

The step of supplying a mixture preferably includes the step of moving the slope. More preferably, the slope includes a ring belt having an opening in the center, and the slope is moved by rotating the ring belt.

The method may further include the step of collecting the ball media dropping from the opening formed in the center of the ring belt.

The machine for sorting out ball media of the present invention includes a slope including a ring belt having an opening in the center, for receiving a mixture including ball media and an object to be polished, and a driver for rotating the slope.

The slope preferably includes a rubber layer on the surface.

Hereinafter, the function of the present invention will be described.

The method for chamfering a rare earth alloy of the present invention, which adopts a polishing method utilizing vibration of a mixture of polishing media and work pieces, like a vibration barrel polishing method, can suppress chipping of work pieces of a highly brittle rare earth alloy. In particular, by using balls as the media, chipping can be further effectively suppressed. Especially, ball media are preferably used for work pieces including a rigid major phase mainly causing brittle fracture and a grain boundary phase causing a ductile fracture, such as work pieces of a rare earth alloy produced by sintering (rare earth sintered alloy), which are especially easily chipped. Moreover, using ball media makes it possible to employ a method for sorting out ball media described later. By employing this method, chipping in the sorting process can be suppressed.

The spacer particles (0.1% to 10% by volume of the liquid medium), supplied together with the rare earth alloy work pieces and the media, attach to the surfaces of the rare earth alloy work pieces, and serve to prevent the work pieces from adhering to each other due to surface tension of the liquid medium during polishing. If the volume content of the spacer particles is less than 0.1%, the effect of suppressing adhesion of the work pieces to each other is not sufficient. If it exceeds 10%, the polishing efficiency may be reduced. The content of the spacer particles is more preferably in the range of 0.3% to 3% by volume of the liquid medium from the standpoints of the adhesion prevention effect and the polishing efficiency. In particular, in the case of using ball media, the inter-medium space tends to be large, compared with the case of using triangle-shaped media (including media in a triangular pyramid shape and cone-shaped media), and thus work pieces easily adhere to each other. In this case, therefore, the effect obtained by adding the spacer particles is especially great.

The liquid medium is fed into the container so that at least three-fourths of the rare earth alloy work pieces and the media put in the container are immersed in the liquid medium. By this immersion, the adhesion of the work pieces to each other can be further effectively suppressed. More preferably, the liquid medium is fed so that the entirety of the rare earth alloy work pieces and the media are immersed in the liquid medium. A liquid medium prepared by adding an anticorrosive and a surfactant to water is suitable for use. The anticorrosive is preferably added because a rare earth alloy easily corrodes (rusts).

If the rare earth alloy work pieces adhere to each other, some edges thereof fail to collide with the media, resulting in non-uniform chamfering. According to the method of the present invention, since such adhesion of work pieces to each other is suppressed, uniform chamfering is realized. In addition, in the sorting process after the polishing, the rare earth alloy work pieces can be easily collected as independent pieces from each other since they are free from adhering to each other. Also, having no adhesion of work pieces to each other, the liquid medium is not allowed to stay between the work pieces. This provides the effect of suppressing corrosion of the rare earth alloy work pieces.

The "spacer particles" as used herein refers to particles having the function of forming spaces between the rare earth alloy work pieces as the objects to be polished (suppressing adhesion of the work pieces to each other) as described above. Various particles can be used as the spacer particles. The average particle size of the spacer particles is preferably in the range of 0.05 mm to 1 mm, more preferably in the range of 0.1 mm to 0.5 mm. The shape of the particles is preferably closer to a sphere. As such spacer particles, polishing particles may be used, but polishing ability is not necessarily required. For example, polymer particles may be used.

The specific gravity of the media is preferably 4 or less to enable suppression of chipping of rare earth alloy work pieces. The media having a specific gravity exceeding 4 gives great impact to the rare earth alloy work pieces, causing chipping. Therefore, it is preferable to use media having a specific gravity of 4 or less. As for the spacer particles, particles having a specific gravity of 4 or less are easily dispersed in the liquid medium uniformly by the movement of the media and the liquid medium, and thus are preferred from the standpoint of preventing adhesion of work pieces to each other.

As the media, it is preferable to use media including alumina grains and a binder where the weight percentage of the alumina grains is in the range of about 45% to about 48%. By using such media, appropriate polishing efficiency is obtained while chipping of the rare earth alloy work pieces is suppressed. Moreover, by using media having a porosity of 3% or less, appropriate polishing efficiency is obtained while chipping of the work pieces is suppressed.

In the vibration polishing process, the container is vibrated so that the amplitude in the horizontal direction exceeds 0.4 mm. By this vibration, the polishing efficiency can be enhanced while chipping is suppressed. During this vibration, the amplitude in the vertical direction is preferably 0.15 mm or more. Moreover, the polishing efficiency can be further enhanced by vibrating the container at an acceleration of 800 mm/sec$^2$ or more in the horizontal direction.

In the method for sorting out the ball media of the present invention, the mixture including the ball media and the objects to be polished is supplied to the slope. The ball media, which are spheres, roll along the slope to be finally removed from the slope. The objects to be polished, which are generally polyhedrons having edges and therefore have high friction resistance against the slope, stay on the slope. In other words, the ball media and the objects to be polished are sorted from each other by the fact that the ball media having a easy-to-roll shape are removed from the slope on one hand and the objects to be polished having a shape causing large friction against the slope stay on the slope on the other hand.

By moving the slope to which the mixture including the ball media and the objects to be polished are supplied, the sorting of the ball media from the objects to be polished can be made efficiently even when the mixture is supplied continuously. More specifically, if the area of the slope is too small for the amount of the mixture supplied, the objects to be polished stay on the slope at a high density, blocking the rolling of the ball media and causing chipping of the objects due to collision between the objects. By moving the slope, that is, by supplying the mixture continuously to portions of the slope on which no objects stay, the above problems can be prevented.

Continuous movement of the slope can be realized by a comparatively simple construction by forming a ring belt having an opening in the center as the slope and rotating the ring belt continuously. More specifically, the mixture is supplied to a portion of the slope, and the slope on which the objects to be polished selectively stay is rotated. The objects staying on the portion of the slope are collected by the time when the portion of the slope returns to the position at which the mixture is supplied. The ball media dropping from the opening formed in the center of the ring belt are collected in a container. Thus, the ball media can be easily collected.

The machine for sorting out ball media of the present invention includes the slope formed of a ring belt having an opening in the center for receiving the mixture including the ball media and the objects to be polished and a driver for rotating the slope. With this machine, the sorting method described above can be efficiently executed. Moreover, by forming a rubber layer on the surface of the slope, even objects to be polished in a comparatively easy-to-roll shape can be kept to stay on the slope stably and reliably.

DETAILED DESCRIPTION OF THE INVENTION

Hereinafter, embodiments of the method for chamfering a rare earth alloy, the method for sorting out ball media, and the machine for sorting out ball media used for this method according to the present invention will be described. In particular, an embodiment of the method for chamfering a rare earth alloy using ball media will be described. The method and machine for sorting out ball media will be described as being used in a process following the chamfering process. It should, however, be noted that the present invention is not limited to the embodiments to follow. Media other than ball media can be used for the chamfering method of the present invention. Also, the method and machine for sorting out ball media are broadly used for applications of sorting out ball media from objects to be polished.

Figure 1:
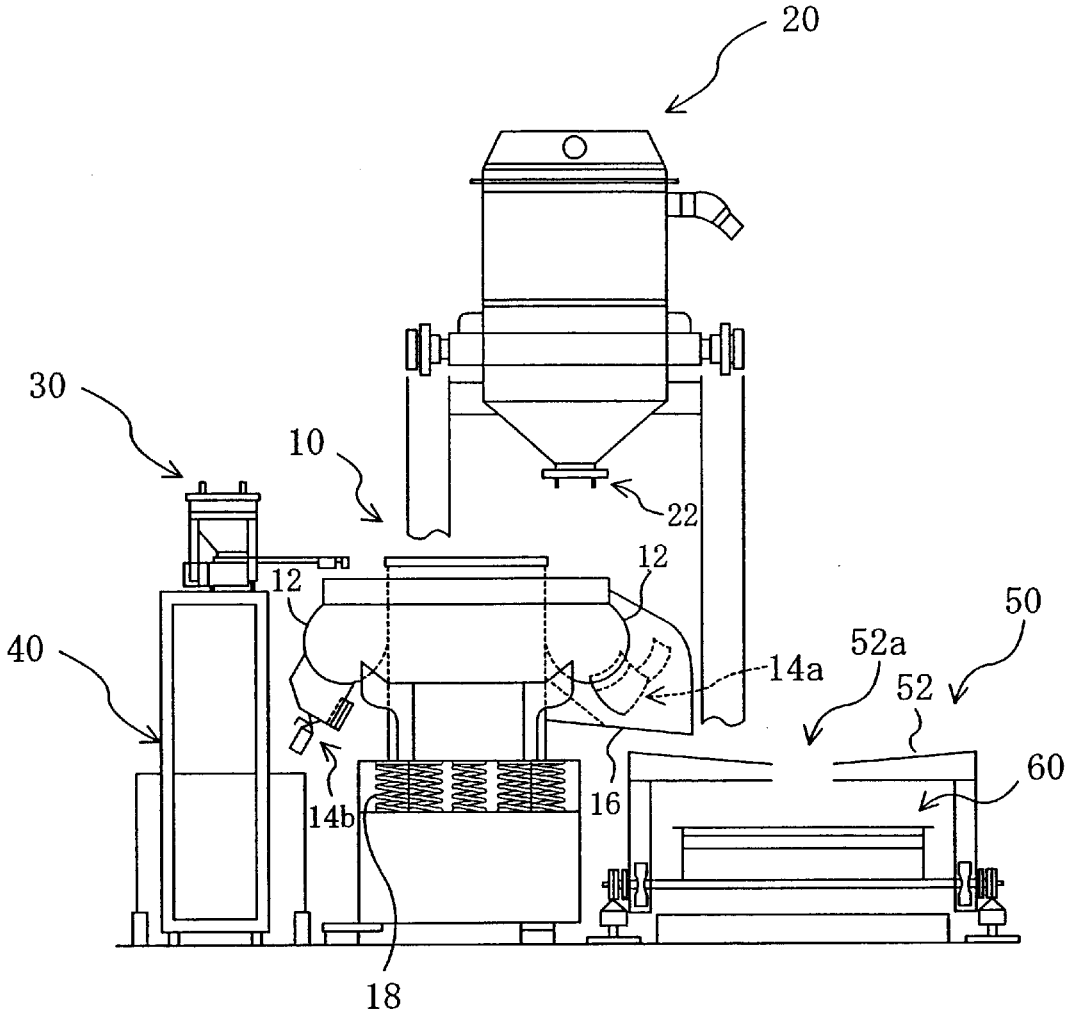
FIG. 1 is a schematic view of a chamfering system 100 used in a method for chamfering a rare earth alloy of an embodiment of the present invention.

FIG. 1 schematically illustrates a chamfering system 100 used in the method for chamfering a rare earth alloy of this embodiment. The system 100 is adapted to perform operations including chamfering of work pieces and subsequent sorting out of ball media.

The system 100 includes a vibration barrel polishing machine 10, a media tank 20, a spacer particle feeder 30, a waste tank 40, and a sorting machine 50.

The vibration barrel polishing machine 10 used for the chamfering method of this embodiment is a circular vibration barrel polishing machine including a container 12 in a ring shape having a roughly circular cross section (for example, Type CV-250-C manufactured by PMG Corp.). The container 12 of the vibration barrel machine 10 is in a roughly horizontal position in an inactivated state. The top portion of the container 12 is open to allow observation of the inside during operation. The container 12 is lined with rubber. A predetermined amount of media stored in the media tank 20 located above the container 12 is dropped from an outlet 22 thereof into the container 12 via the top opening of the container 12. In addition to the media, work pieces, a liquid medium, and spacer particles are also fed into the container 12 via the top opening. The spacer particles of a predetermined amount are fed from the spacer particle feeder 30 into the container 12. These materials are fed under predetermined conditions to be described later. The container 12 is then vibrated, to execute the barrel polishing process.

A first outlet 14*a* and a second outlet 14*b* are provided at the bottom of the container 12. The first outlet 14*a* is used to discharge the media and the work pieces to the sorting machine 50. A mixture of the media and the work pieces discharged from the first outlet 14*a* moves along a slow inclined surface 16 to be supplied to a slope 52 of the sorting machine 50. As will be described later, the media are sorted out from the mixture supplied to the slope 52 of the sorting machine 50, and the sorted-out media are collected in a collecting container 60. The work pieces left to stay on the slope 52 are collected by hand, for example, and sent to a subsequent stage (cleaning process, for example). The second outlet 14*b* is used to collect the liquid medium (including sludge after polishing) in the waste tank 40.

Hereinafter, the polishing process in the embodiment of the present invention will be described in detail.

First, work of a rare earth alloy as the object to be polished will be discussed.

Rare earth alloys to which the chamfering method of this embodiment is applied are R—Fe—B rare earth sintered alloys disclosed in U.S. Pat. Nos. 4,770,723 and 4,792,368 assigned to the assignee of the present invention. Among the R—Fe—B rare earth alloys, chipping particularly easily occur for a rare earth sintered alloy containing neodymium (Nd), iron (Fe), and boron (B) as major components and essentially composed of a rigid major phase (iron-rich phase) made of a tetragonal $Nd_2Fe_{14}B$ intermetallic compound and a viscous Nd-rich grain boundary phase (hereinafter, such an alloy is called a "neodymium alloy") to which Co is added to enhance the heat resistance (see Japanese Laid-Open Patent Publication No. 5-214495).

Figure 2A:
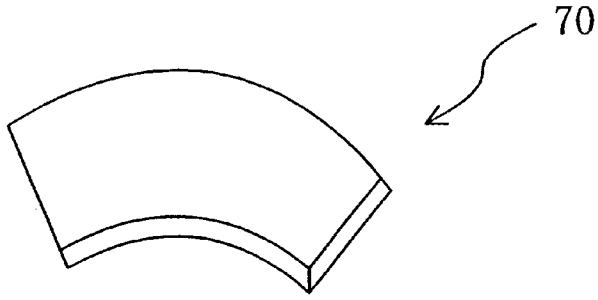
FIG. 2A is a schematic view of an example of neodymium alloy work 70 used in a barrel polishing process in the chamfering method of the embodiment.

In this embodiment, as the neodymium alloy, flat work pieces 70 in a shape as shown in FIG. 2A (weight: about 15 g (specific gravity: about 7.5), thickness: about 3 mm) were used, for example. Conditions for chamfering the neodymium alloy work pieces 70 so that the radius of curvature at the edge of the work piece 70 was in the range of 0.2 mm to 0.5 mm were examined. Note that the maximum surface roughness of 3 $\mu$m to 5 $\mu$m can be obtained under the conditions described below. The neodymium alloy work pieces 70 were obtained by cutting a sintered neodymium alloy block.

The neodymium alloy used in this embodiment is a material particularly susceptible to chipping. Therefore, even if some of the conditions to follow are not satisfied, the effect of suppressing chipping may be provided sufficiently when work pieces of other rare earth alloys are chamfered.

Figure 2B:
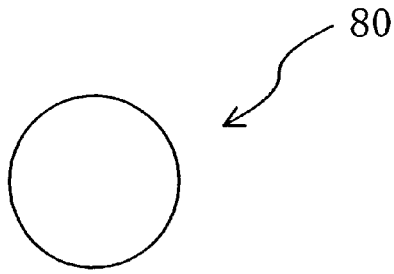
FIG. 2B is a schematic view of a ball medium 80 used in the chamfering method of the embodiment.

As the media, balls 80 in a shape as shown in FIG. 2B were used. The ball media 80 have a small impact force against the work pieces 70, compared with triangle-shaped media and the like. Therefore, the ball media 80 are effective in suppressing chipping and also superior in uniformity of chamfering. Moreover, by using the ball media 80, the sorting method to be described later can be employed. By employing this method, chipping in the sorting process can be prevented. Note that advantageous natures of the ball media 80 to be described below are also applicable to triangle-shaped media.

The ball media 80 are preferably made of a ceramic material having a specific gravity of 4 or less. Ball media having a specific gravity exceeding 4 will give a great impact to the work pieces 70, and therefore chipping tends to occur. Ball media including alumina ($Al_2O_3$) grains are particularly preferred. In addition to the alumina grains and a binder, the ball media may also include SiC grains (GC and C grains, for example).

Figure 2C:
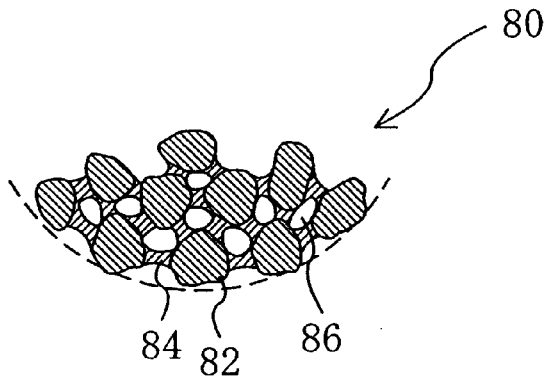
FIG. 2C is a partial enlarged view of the ball medium 80.

For example, as shown in FIG. 2C, each ball medium preferably includes alumina grains 82 immobilized by a binder 84 made of clay (or quartz or feldspar). Since alumina is comparatively soft, chipping of the work pieces 70 is suppressed. From the standpoint of the chamfering efficiency, the percentage of grain (weight percentage of grains with respect to the total weight of the medium) is preferably in the range of about 45% to about 48% as will be described later. If the percentage of grain is less than 45%, the load on each grain is large, causing abnormal shedding of grains, and thus the chamfering amount decreases mainly due to shedding of grains. If the percentage of grain exceeds 48%, the inter-grain distance is so small that the load on each grain decreases, and thus the chamfering amount decreases mainly due to clogging of the medium.

Each ball medium 80 also includes pores 86 as shown in FIG. 2C. The content of the pores 86 (that is, the porosity) is preferably 3% or less, more preferably 1% or less. Having the porosity of 3% or less, the binder 84 can immobilize the grains 82 with an appropriate force against the rare earth alloy, and this causes appropriate shedding of the grains 82. Thus, the neodymium alloy work pieces 70 that are hard to be polished can be polished efficiently while suppressing chipping. If the porosity exceeds 3%, the polishing amount increases, but the load on the work pieces 70 becomes too large, causing chipping. In addition, the wear amount of the ball media 80 increases, thereby reducing the use efficiency of the ball media 80.

The diameter of the ball media 80 is preferably in the range of about 10 mm to about 20 mm to chamfer the edges of the work pieces 70 so that R=0.2 mm to 0.5 mm. As the ball media 80, balls having different diameters may be mixed. In this case, the average diameter of all ball media is preferably in the above range.

In the polishing process in this embodiment, the ball media 80 of a predetermined amount are dropped into the container 12 (the amount depends on the volume of the container), and the work pieces 70 in an amount of about a tenth to about a hundredth of the total amount of the ball media 80 are polished. The amount of the work pieces 70 may be changed as appropriate.

During the polishing, the work pieces 70 and the ball media 80 are immersed in a liquid medium to prevent the work pieces 70 from adhering to each other. At least three-fourths of the entire bulk volume are preferably immersed in the liquid medium. More preferably, the entire of the bulk volume are immersed. In the conventional polishing in which polishing is performed under continuous running of a small amount of a liquid medium (in the state that less than one-fourth of the entire bulk volume is immersed in the liquid medium), flat work pieces such as the work pieces 70 tend to firmly adhere to each other. This state is maintained throughout the polishing process, thereby failing to provide uniform chamfering. This phenomenon is especially significant when ball media are used because the inter-medium distance is large compared with triangle-shaped media. This adhesion can be suppressed to some extent by filling the container 12 with a sufficient amount of the liquid medium so that the work pieces 70 are kept immersed in the liquid medium in most of the polishing process. A liquid medium prepared by adding an anticorrosive and a surfactant to water is preferably used.

In the polishing process in this embodiment, spacer particles are mixed in the liquid medium in an amount of 0.1% to 10% by volume of the liquid medium. This further suppresses adhesion of the work pieces 70 to each other. Specifically, spacer particles attach to the surfaces of the work pieces 70 to suppress the work pieces 70 from adhering to each other due to the surface tension of the liquid medium during the polishing. If the amount of the spacer particles is less than 0.1%, the effect of suppressing the adhesion of the work pieces 70 to each other is insufficient. If it exceeds 10%, the polishing efficiency may be reduced. The amount of the spacer particles is more preferably in the range of 0.3% to 3% by volume of the liquid medium from the standpoints of the adhesion prevention effect and the polishing efficiency.

The specific gravity of the spacer particles is preferably 4 or less. The spacer particles having a specific gravity of 4 or less are easily dispersed uniformly under the movement of the media 80 and the liquid medium, and thus adhesion of the work pieces 70 to each other can be effectively suppressed. The average particle size of the spacer particles is preferably in the range of 0.05 mm to 1 mm, more preferably in the range of 0.1 mm to 0.5 mm. The shape of the particles is preferably closer to a sphere. As such spacer particles, polishing particles such as SiC particles (for example, GC grains #100) can be used. Otherwise, polymer particles such as polystyrene beads (for example, PLC beads manufactured by PMG Corp.) may be used. Since GC grains have a polishing ability, reduction in chamfering amount is comparatively small when an excessive amount of grains are added. PLC beads exhibit a comparatively large adhesion prevention effect. However, since PLC beads have no polishing ability, reduction in chamfering amount is large when an excessive amount of PLC beads are added.

Hereinafter, a specific example of the polishing process in this embodiment will be described. The polishing process was conducted by using the vibration barrel polishing machine, Type CV-250-C manufactured by PMG Corp. As the work pieces, used were flat neodymium alloy work pieces (specific gravity: about 7.5) in a shape as shown in FIG. 2A having a unit weight of about 8 g.

As the ball media, ceramic media (specific gravity: about 2.6) were used, each including aluminum grains (percentage of grain: 46 wt %), having a porosity of about 1%, and a diameter of about 14 mm.

As the liquid medium, used in this example was TKX Compound #803 (product name) manufactured by Kyoeisha Chemical Co., Ltd (specific gravity: 1.05 to 1.1.0). Also usable is water (50 to 70 mass %) to which an anticorrosive (5 to 35 mass %) and, as required, a surfactant (5 mass % or less) and an antifoaming agent (5 mass % or less) are added. Various types of these liquids, or compounds, are commercially available.

As spacer particles, GC grains (#100, specific gravity: about 3.1) and polystyrene beads (PLC beads, average particle size: 0.5 mm, specific gravity: about 1.05) were added to the liquid medium. Barrel polishing was performed with the media and the work pieces being immersed in the liquid medium. For comparison, barrel polishing was also performed while continuously running the liquid medium as in the conventional method. The container was vibrated at 60 Hz, and barrel polishing was performed for about 2 hours. The duration of the barrel polishing may be changed appropriately as required. The typical conditions and the resultant work adhesion occurrence rate for each case are shown in Table 1 below.

First, in the case of performing barrel polishing while continuously running of the liquid medium at a rate of about 100 $cm^3$/min (in the state that less than one-fourth of the total bulk volume is immersed) as in the conventional method, the work adhesion occurrence rate was as high as 20% despite of the addition of spacer particles. On the contrary, in the case of performing barrel polishing in the immersed state, the work adhesion occurrence rate was as low as about 5% even when no spacer particles were added. Thus, by keeping the media and the work pieces immersed in the liquid medium during the barrel polishing, the occurrence rate of adhesion of work pieces to each other can be reduced. Moreover, by adding spacer particles to the liquid medium, the adhesion can be completely prevented, at least in the cases shown in Table 1. From these results, it is found that adhesion of work pieces to each other can be significantly and efficiently prevented by mixing the spacer particles in the liquid medium and also performing barrel polishing in the immersed state. At least three-fourths of the bulk volume of the media and the work pieces are preferably immersed during the barrel polishing.

Comparison between the effects of GC grains and polystyrene beads is as follows. The polishing amount increased, although slightly, when GC grains were added, compared with the case of adding no spacer particles. On the contrary, the polishing amount decreased when polystyrene beads were added, compared with the case of adding no spacer particles. This is probably because while GC grains have a polishing ability, polystyrene beads have little polishing ability. The volume effect (number effect) is also considered influential because the specific gravity of polystyrene beads is smaller than that of GC grains. Moreover, since the specific gravity of polystyrene beads (about 1.05) is roughly the same as that of the liquid medium (1.05 to 1.10 in this example), dispersion of polystyrene beads in the liquid medium is superior to that of GC grains, providing a lubricating effect. This is also considered contributable to the reduction in polishing amount. As a result of examination in various ways, it has been found that occurrence of adhesion of work pieces to each other can be efficiently prevented without lowering the polishing efficiency by adding the spacer particles having a specific gravity of 4 or less to the liquid medium in an amount of 0.1% to 10% by volume, more preferably 0.3% to 3% by volume of the liquid medium.

In the case of the barrel polishing while continuously running the liquid medium, the polishing amount was greater than the barrel polishing in the immersed state. However, the following problems were found. That is, chips (herein defined as those having a diameter of 1 mm or more) were observed, and the polishing amount lacked uniformity (some edges failed to be chamfered). On the contrary, in all the cases of the barrel polishing in the immersed state, no chipping was recognized. The reason is presumably as follows. When the media and the work pieces are in the immersed state during the barrel polishing, they are forced to move unitedly in the presence of the liquid medium. This may reduce the impact force between the media and the work pieces, compared with the case that only a small amount of liquid medium exists. Further, in all the cases including the addition of spacer particles, no adhesion of work pieces to each other was observed, and thus uniform chamfering was also possible.

In the above example of the barrel polishing in the immersed state, the liquid medium steadily remained in the container throughout the barrel polishing process. Alternatively, the liquid medium may be made to keep running in the state that at least three-fourths of the entire media and work pieces have been immersed in the liquid medium unless the spacer particles flow out so much that the amount thereof is reduced excessively. For example, when a large amount of sludge is generated, such sludge can be discharged preferentially from the second outlet 14*b* at the bottom of the container 12 because sludge of the neodymium alloy work pieces has a large specific gravity. During this discharge, amounts of the liquid medium and the spacer particles equal to those discharged together with the sludge may be appropriately added so that the above conditions are satisfied.

TABLE 1

| | | | | | |
|---|---|---|---|---|---|
| Work Unit weight | 8 g | 8 g | 8 g | 8 g | 8 g |
| No. of pieces | 1500 pcs. | 880 pcs. | 500 pcs. | 925 pcs. | 500 pcs. |
| Total weight | 12 kg | 7 kg | 4 kg | 7.4 kg | 4 kg |
| Total weight of media | 250 kg | 250 kg | 250 kg | 250 kg | 250 kg |
| Liquid medium | Running | Immersion | Immersion | Immersion | Immersion |
| Spacer particles | GC grains 800 g | GC grains 2000 g | GC grains 1000 g | Polystyrene Beads 1000 g | None — |
| Adhesion occurrence Rate | 20% | 0% | 0% | 0% | 5% |
| Polishing amount (R) | 0.29 mm | 0.25 mm | 0.25 mm | 0.19 mm | 0.24 mm |

Figure 3:
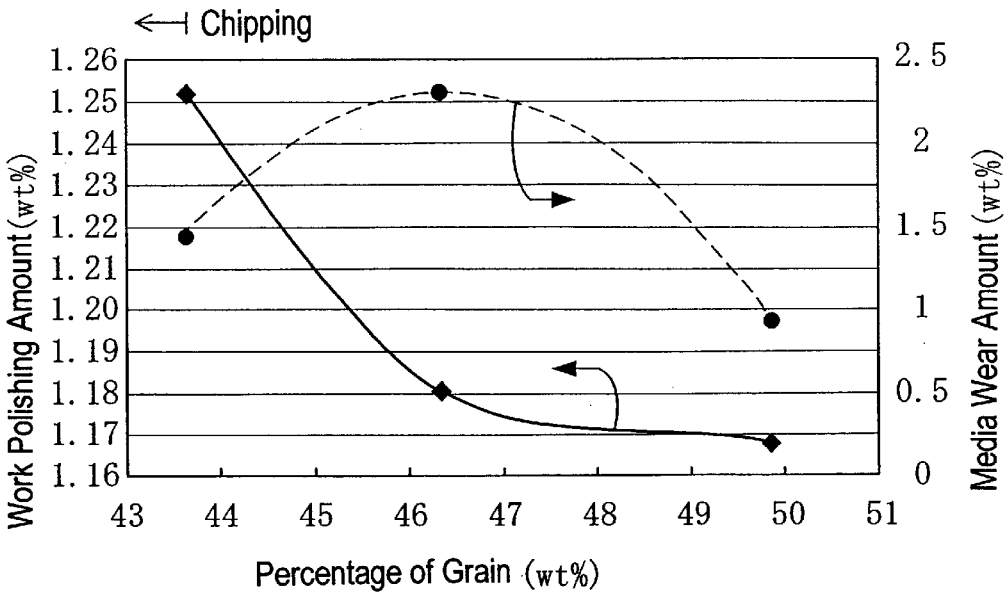
FIG. 3 is a graph showing the relationships of the percentage of grain of alumina ball media with the work polishing amount and the media wear amount in the barrel polishing process in the chamfering method of the embodiment.

Optimization of the media is another reason why chipping was prevented, in addition to the reason described above. Referring to FIG. 3, the relationships of the percentage of grain of alumina ball media with the work polishing amount and the media wear amount will be described. FIG. 3 shows examples of these relationships obtained by using media having a porosity of 0.3% to 3%.

As described above, alumina media was used as the ball media in this embodiment, which are comparatively soft and cause less chipping on neodymium alloy work pieces. Even when such alumina media are used, the work polishing amount and the media wear amount vary with the percentage of grain of the alumina media. If the percentage of grain is less than 40 wt %, chipping becomes significant. If it exceeds 50 wt %, clogging may occur which results in abrupt reduction in polishing.

More specifically, as shown in FIG. 3, when the percentage of grain is in the range of 45 wt % to 48 wt %, chipping is scarcely observed, the polishing efficiency is high, and the media wear amount is comparatively small. This is presumably because, when the percentage of grain is within the above range, the maintenance of grains and the shedding of grains are well balanced, causing the media to be appropriately worn and thus enabling the media to maintain the polishing force. If the percentage of grain is less than 45 wt %, the load on each grain becomes large, causing abnormal shredding of grains. Therefore, the polishing amount decreases mainly due to shedding of grains. This also increases the media wear amount, and generates chipping. If the percentage of grain exceeds 48%, the inter-grain distance is so small that the load on each grain decreases, causing failure of appropriate shedding of grains. As a result, the polishing amount decreases mainly due to clogging of the media.

Figure 4:
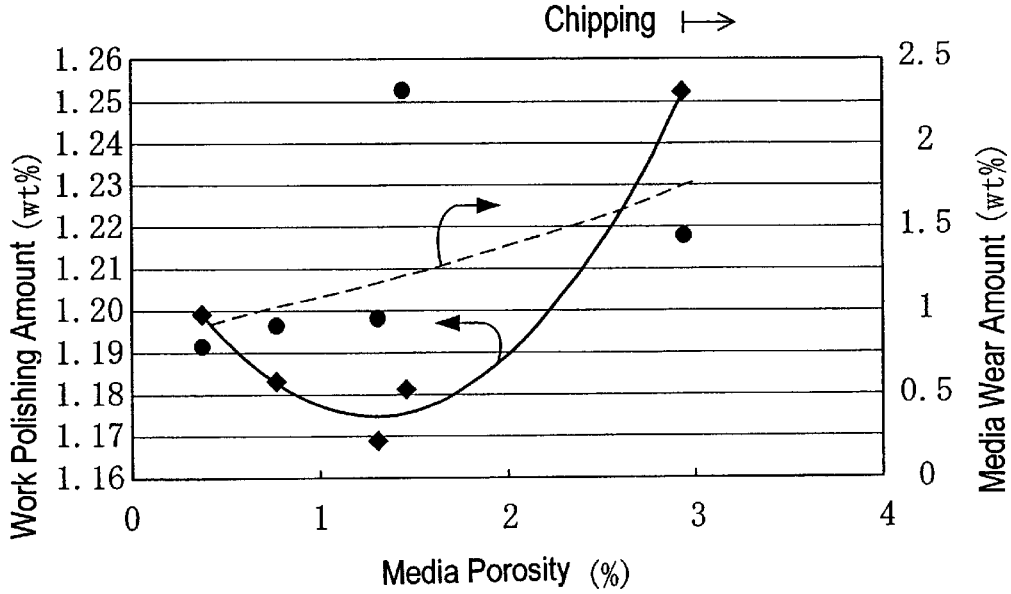
FIG. 4 is a graph showing the relationships of the porosity of the media with the work polishing amount and the media wear amount in the barrel polishing process in the chamfering method of the embodiment.

Next, referring to FIG. 4, the relationships of the media porosity with the work polishing amount and the media wear amount will be described. FIG. 4 shows examples of these relationships obtained by using media having a percentage of grain of 43.5 wt % to 49.5 wt %.

As shown in FIG. 4, with a porosity of 3% or less, the binder immobilizes the grains with an appropriate force. Therefore, shedding of grains occurs appropriately, enabling hard-to-be-polished neodymium alloy work pieces to be efficiently polished while suppressing chipping. If the porosity exceeds 3%, the polishing amount increases, but the load on the work pieces becomes excessively large, causing chipping. The media wear amount also increases, reducing the use efficiency of the media.

The porosity is represented by $\{(W3-W1)/(W3-W2)\}\times 100(\%)$ wherein W1, W2, and W3 denote the dry weight, the underwater weight, and water-absorbed weight, respectively, of the media. In this example, the weights W1, W2, and W3 were measured in the following manner to obtain the porosity. Specifically, the media was dried by being kept at a temperature of 100° C. or more for 60 minutes, and then weighed within one minute after the drying to obtain the dry weight W1. The media were boiled in boiling water for 60 minutes and then immersed in water to weigh the media as the underwater weight W2. Note that in this measurement of the underwater weight W2, a small amount of a surfactant (for example, a domestic detergent) was added to the water to reduce the surface tension. The media boiled in boiling water for 60 minutes were lightly wiped with a wet towel to remove water, and immediately weighed to obtain the water-absorbed weight W3.

Next, referring to FIGS. 5 and 6, the vibration state and the polishing efficiency of the barrel polishing machine 10 will be described.

Figure 5:
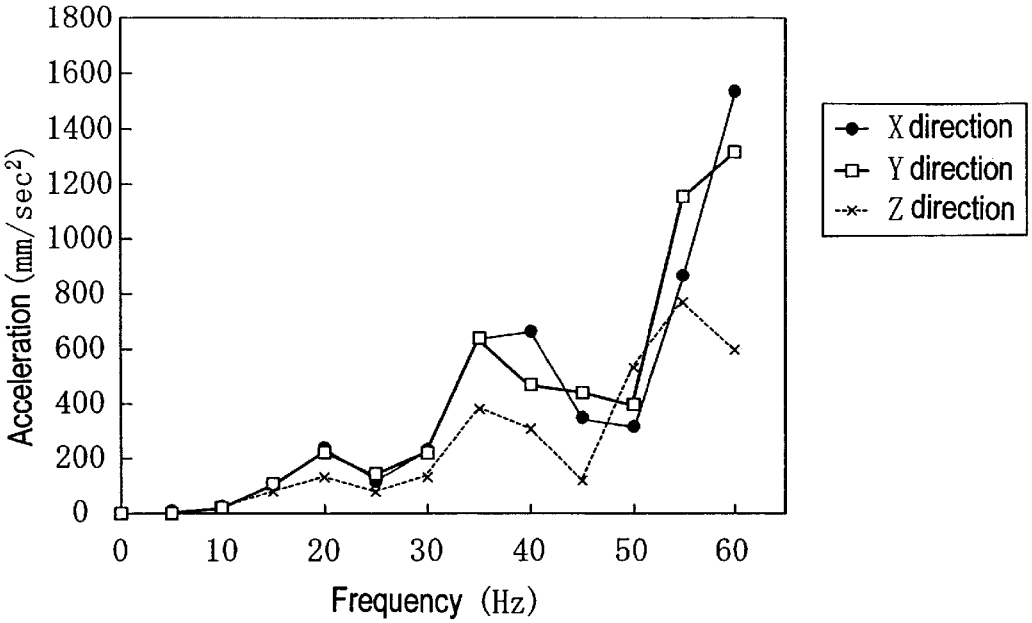
FIG. 5 is a graph showing the relationship between the frequency and the acceleration in the barrel polishing process in the chamfering method of the embodiment.
Figure 6:
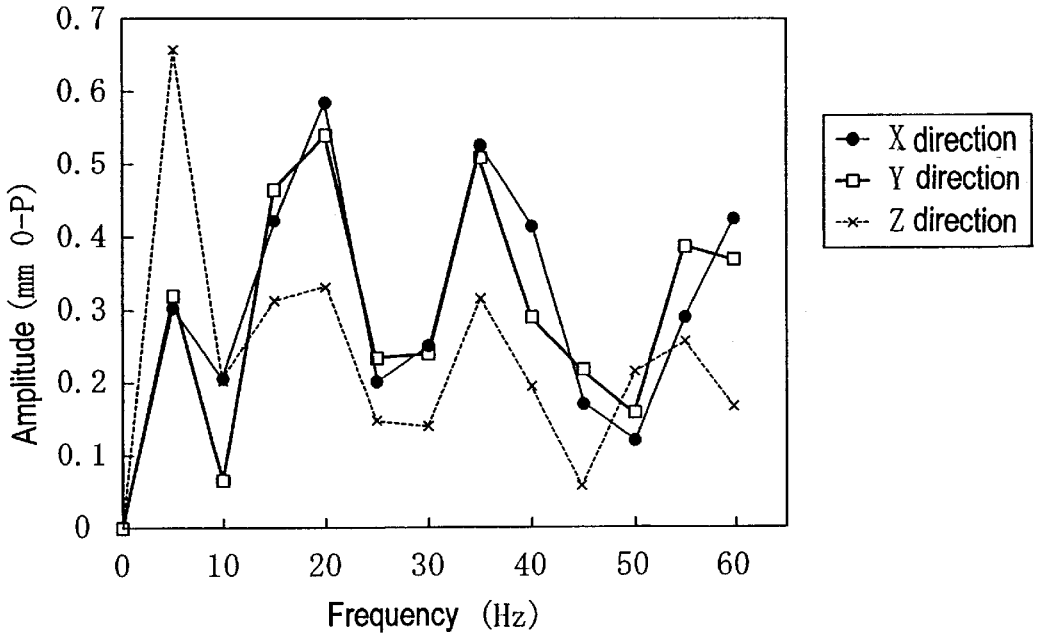
FIG. 6 is a graph showing the relationship between the frequency and the amplitude in the barrel polishing process in the chamfering method of the embodiment.

FIG. 5 is a graph showing the relationship between the frequency (unit: Hz) and the acceleration (unit: mm/sec$^2$), and FIG. 6 is a graph showing the relationship between the frequency and the amplitude (zero peak, unit: mm). These graphs show the results in three directions orthogonal to one another, that is, x, y, and z directions, where the x and y directions are defined in a horizontal plane and the z direction is defined in a vertical plane. The frequency can be controlled by adjusting the strength of springs 18 of the barrel polishing machine 10, for example.

As is apparent from FIG. 5, the acceleration tends to increase with increase of the frequency. Since the acceleration is considered roughly proportional to the polishing force, the polishing force presumably increases with an increase of the frequency. Therefore, in order to improve the polishing efficiency, the barrel polishing is preferably performed at a comparatively high frequency. As is observed from FIG. 5, however, there exist regions (at and around frequencies 25 Hz and 50 Hz) in which the acceleration drops despite the increase of the frequency. This is due to resonance of the machine, and these frequencies are natural frequencies of the machine (the natural frequency may change when the weight of the container 12 (amounts of the media and the work pieces fed) greatly changes). It is therefore preferable to avoid a frequency near the resonance point.

The polishing force is also considered roughly proportional to the amplitude. As is observed from FIG. 6, the amplitude is easily influenced by the frequency but the influence has no fixed tendency. In order to secure a sufficiently high polishing force, the frequency is preferably set so that the amplitudes in the horizontal directions (x and y directions) are about 0.4 mm or more, and more preferably set so that the amplitude in the vertical direction (z direction) is 0.15 mm or more in addition to the above setting.

From the above results, it is considered that the polishing efficiency can be most improved by selecting a frequency that gives an amplitude of about 0.4 mm or more in the horizontal directions (x and y directions), an amplitude of about 0.15 mm or more in the vertical direction (z direction), and an acceleration as high as possible. The acceleration in the horizontal directions is preferably 800 mm/sec$^2$ or more to improve the polishing efficiency. Specifically, from FIGS. 5 and 6, the frequency is most preferably 60 Hz.

Thus, according to the polishing, as well as chamfering, method of this embodiment, chipping on neodymium alloy work pieces is suppressed. Also, adhesion of work pieces to each other is suppressed, and thus uniform chamfering is possible.

As already described, in this embodiment, chamfering was performed for neodymium alloy work pieces that are very easily chipped. Therefore, in some cases depending on the composition (mechanical properties) of a rare earth alloy, a sufficient effect may be obtained even when any of the conditions described above (for example, the material, the percentage of grain, and the porosity of the media) fails to fall within the ranges defined above.

Figure 7:
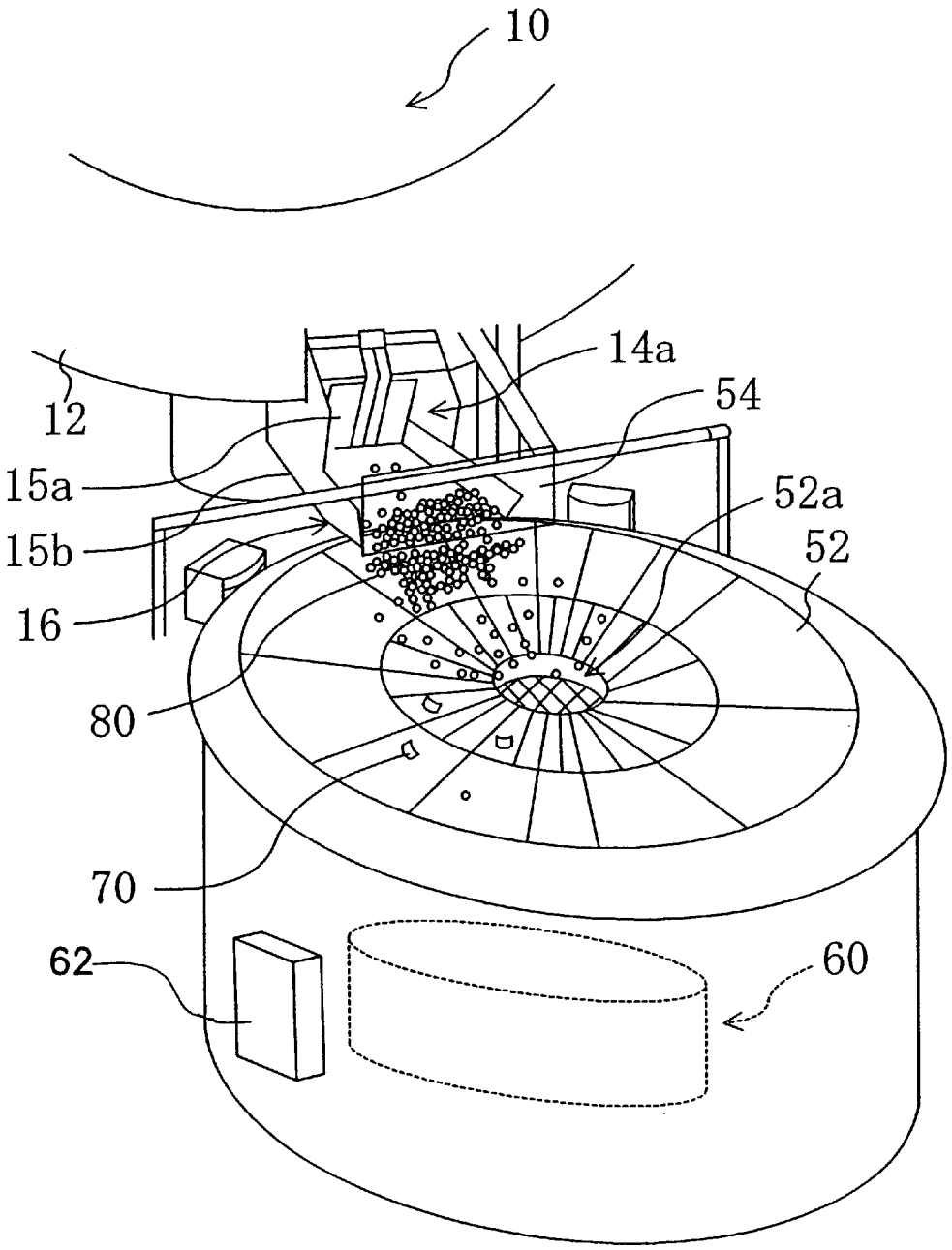
FIG. 7 is a schematic view of a sorting machine 50 for ball media of the embodiment.

Next, referring to FIG. 7, the method and machine for sorting out the ball media will be described. FIG. 7 schematically illustrates the ball media sorting machine 50 located in the vicinity of the first outlet 14*a* of the barrel polishing machine 10.

When a lid 15*a* of the first outlet 14*a* of the barrel polishing machine 10 is mechanically opened and the container (also called a barrel bath) 12 is appropriately vibrated, the media 80 and the work pieces 70 are discharged through the outlet 14*a* toward the sorting machine 50. Prior to this operation, the liquid medium (including sludge) is discharged through the second outlet 14*b* into the waste tank 40.

The mixture of the media 80 and the work pieces 70 discharged move along an inclined bottom plate 15*b* of the first outlet 14*a* and then the slow inclined surface 16 to be supplied to the slope 52 of the sorting machine 50. The inclined surface 16, formed by rubber-lining the surface of a metal plate, has a tilt angle of 10 to 30 degrees, for example. By appropriately vibrating the container 12, the work pieces 70 together with the ball media 80 are supplied to the slope 52 of the sorting machine 50. The vibration required for discharge of the mixture of the ball media 80 and the work pieces 70 from the container 12 may be smaller than the vibration during the polishing process and be appropriately adjusted.

The slope 52 is formed of a ring belt having an opening 52*a* in the center (having an inverted truncated cone shape) and is rotated around the center thereof with a driver 62. The surface of the slope 52 is also rubber-lined forming a rubber layer (not shown), for example, providing a comparatively large friction resistance. In addition, the slope 52 is not vibrated, unlike the inclined surface 16. Therefore, the slope 52 has a tilt angle (for example, 5 to 20 degrees, typically 10 to 15 degrees; in this embodiment about 12 degrees) smaller than the inclined surface 16, so that the work pieces 70 can be left to stay on the slope 52. The slope 52 does not necessarily have a single tilt angle down to the opening 52*a*. Instead, as in the illustrated example, the tilt angle may be reduced in stages (or sequentially) toward the center opening 52*a*. In addition, a dam (blocking plate) 54 may be placed to block the work pieces 70 from directly rolling down toward the opening 52*a* together with the ball media 80, to thereby ensure all the work pieces 70 are brought into direct contact with the slope 52. The dam 54 is placed on the slope 52 with a gap that is larger than the diameter of the media 80 and smaller than twice the diameter of the media 80 therebetween. In general, the ball media 80 used has a diameter larger than the thickness of the flat work pieces 70.

The ball media 80, which have a spherical shape, roll downward along the slope 52 despite of the comparatively large friction resistance of the slope 52 and drop from the opening 52*a*. The selectively-dropped ball media 80 are collected in the media collecting container 60 placed under the opening 52. The work pieces 70 staying on the slope 52 are collected by hand by an operator, for example, to be sent to a subsequent stage (cleaning process, for example).

The slope 52 is rotated at a rotational speed of 4 rpm, for example (the slope 52 illustrated has an outer diameter of about 1200 mm and an inner diameter of about 250 mm, for example). Therefore, the work pieces 70 have been collected and none is left on a portion of the surface of the slope 52 when the portion is moved to the position under the first outlet 14*a*. In this way, the mixture of the work pieces 70 and the media 80 is continuously supplied to portions of the slope 52 on which no work pieces 70 are left. This prevents problems such that the work pieces 70 stay on the slope 52 at an increased density blocking rolling of the ball media 80 and that chipping occurs due to collision between any remaining work pieces 70. In the case that the area of the slope 52 is sufficiently large with respect to the amount of the mixture supplied, it is not necessary to move the slope 52.

In the above example, the slope 52 was constructed of a ring belt having the opening 52*a* in the center. Alternatively, the slope may be linear. For example, an inclined surface of an endless belt may be used as the slope. The ring slope is advantageous in that a comparatively small sorting machine can be constructed. On the contrary, by using an endless belt, it is possible to adjust the duration of the sorting process (and the length of the sorting machine) by adjusting the length of the endless belt or the number of endless belts.

As described above, in the method for sorting out ball media of this embodiment, ball media can be sorted out while suppressing collision between work pieces. Therefore, chipping can be suppressed in the sorting process. This sorting method can be executed by the illustrated machine for sorting out ball media that is comparatively simple in construction.

According to the present invention, a method for chamfering a rare earth alloy is provided, in which chipping is suppressed and adhesion of work pieces to each other during the polishing which employs polishing media like the barrel polishing, is suppressed to enable uniform chamfering. Also provided are a method for sorting out ball media while suppressing collision between objects to be polished and a machine for sorting out ball media enabling such sorting.

Thus, according to the present invention, since effective polishing and chamfering of a rare earth alloy is possible, yield of products of the rare earth alloy improves. In particular, it is possible to chamfer small-sized components made of a material susceptible to chipping, such as a rare earth alloy used for VCM, with high yield. Moreover, according to the present invention, collision between the small-sized components can be suppressed when ball media are sorted out. Therefore, chipping is prevented from occurring during the process of sorting out the ball media. This further improves the yield of the small-sized components susceptible to chipping.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A method for polishing and chamfering a rare earth alloy comprising the steps of:

preparing rare earth alloy work;

providing media, a liquid medium and spacer particles;

feeding the rare earth alloy work, media, a liquid medium, and spacer particles into a container, the spacer particles being in an amount of 0.1% to 10% by volume of the liquid medium; and subjecting the rare earth work to polishing by vibrating the container.

2. The method of claim 1, wherein the liquid medium is fed into the container so that at least three-fourths of the bulk volume of the rare earth alloy work and the media are immersed in the liquid medium.

3. The method of claim 1, wherein the average particle size of the spacer particles is in a range of 0.05 mm to 1 mm.

4. The method of claim 3, wherein the specific gravity of the media and the specific gravity of the spacer particles are 4 or less.

5. The method of claim 4, wherein the media include alumina grains and a binder, and the weight percentage of the alumina grains is in a range of 45% to 48%.

6. The method of claim 5, wherein the porosity of the media is 3% or less.

7. The method of claim 1, wherein in the step of subjecting the rare earth work to polishing, the container is vibrated so that the amplitude in the horizontal direction is 0.4 mm or more and the amplitude in the vertical direction is 0.15 mm or more.

8. The method of claim 1, wherein in the step of subjecting the rare earth work to polishing, the container is vibrated at an acceleration of 800 mm/sec$^2$ or more in the horizontal direction.

9. The method of claim 1, wherein ball media is used as the media.

* * * * *